United States Patent [19]

DeLorenzo

[11] Patent Number: 4,545,302

[45] Date of Patent: Oct. 8, 1985

[54] VALIDATOR/IMPRINTER APPARATUS

[75] Inventor: Dana DeLorenzo, Brockton, Mass.

[73] Assignee: DBS, Inc., Randolph, Mass.

[21] Appl. No.: 687,254

[22] Filed: Dec. 28, 1984

[51] Int. Cl.[4] ..... B41F 3/18

[52] U.S. Cl. ..... 101/269; 101/DIG. 18; 250/461.1

[58] Field of Search ..... 101/56, 269, DIG. 18, 101/270–274; 250/461.1; 283/85, 89, 72

[56] References Cited

U.S. PATENT DOCUMENTS

| | | | |
|---|---|---|---|
| 3,272,120 | 9/1966 | Johnson | 101/56 |
| 3,467,825 | 9/1969 | Hubert | 250/461.1 X |
| 3,571,570 | 3/1971 | Taulman | 101/269 X |
| 3,597,734 | 8/1971 | Harris, Jr. | 101/DIG. 18 |
| 3,618,517 | 11/1971 | Allport | 101/269 |
| 3,628,016 | 12/1971 | Berler | 250/461.1 |
| 3,752,074 | 8/1973 | White et al. | 101/269 |
| 3,842,281 | 10/1974 | Goodrich | 250/461.1 |
| 3,859,509 | 1/1975 | Dillingham et al. | 101/DIG. 18 |

*Primary Examiner*—Clifford D. Crowder

*Attorney, Agent, or Firm*—Murray, Whisenhunt and Ferguson

[57] ABSTRACT

An imprinter for use with a credit card having fluorescent markings thereon, the imprinter comprising a substantially rectangular bed, a credit card holder for holding the credit card on the bed, a document holder for holding a document on the bed in partially overlapping relationship with the credit card, a carriage containing a print roller for passage over the credit card and document to imprint data from the credit card on the document, an aperture receivable of a credit card formed through said bed and guide means for holding a credit card inserted through the aperture in a predetermined orientation beneath the bed. A credit card validation system is disposed beneath the bed of the imprinter. The credit card validation system comprises a lamp for irradiating the credit card with radiation of a wavelength which will cause fluorescence of the fluorescent markings on the card, a battery for supplying electrical power to the lamp and a switch, activated by insertion of a credit card in the aperture, for electrically interconnecting the battery and the lamp. The fluorescent markings on the card being unique to the issuer thereof and representative of authenticity.

12 Claims, 13 Drawing Figures

VALIDATOR/IMPRINTER APPARATUS

BACKGROUND OF THE INVENTION

This invention relates to devices for taking printing impressions from tokens or printing members with raised characters thereon such as credit cards and the like, such devices being commonly referred to as imprinters. More particularly, this invention relates to an imprinter provided with means for determining credit card validity.

Imprinters have been in use for many years and often consist of a flat bed provided with means to receive and locate the token, and other means to properly position a form overlying the token or card. A print roller mounted on a carriage which travels along the bed is arranged to move over the printing location after the card and form are in place, and is accurately spaced from the bed so as to provide the correct amount of interference with the card and form, thereby generating the desired printing pressure. Electrically operated and manually operated imprinters are both used in commercial establishments.

Manually operated card imprinters are by far more widely used in credit card applications than electrically operated types because of their lower cost and increased portability. However, manually operated imprinters provide no means of verifying credit card authenticity. This function is generally provided by an electrically operated peripheral device (e.g., an electrically operated card reader linked to a computerized data base) which increases system costs and requires additional work area space. Alternatively, the imprinter must be located in close proximity to a telephone in order to allow the imprinter operator to call the credit card issuer and verify authenticity.

SUMMARY OF THE INVENTION

The present invention provides a portable, low cost, manually operated imprinter with a credit card authenticity validation capability.

The present invention achieves this card authenticity validation capability by providing an imprinter comprising a base including a bed and downwardly extending support walls. The bed is substantially rectangular in plan, the length of which is greater than the width thereof, and has a top surface and a bottom surface. A printing plate holder is disposed on the top surface of the bed for holding a portable printing plate, e.g., credit card, in a predetermined location on the top surface of the bed. A document holder is also disposed on the top surface of the bed for holding a document, e.g., a sales slip, in a predetermined location on the top surface of the bed. The document holder is positioned so as to hold the portable printing plate and the document in at least partially overlapping relationship. A carriage is provided which is guidingly and movably mounted on the base for motion in the lengthwise direction of the bed. The carriage contains at least one print roller, movement of the carriage effecting relative movement between the print roller and the bed thereby imprinting data from the portable printing plate to the document. An aperture receivable of a portable printing plate is provided in the bed, the aperture communicating the top surface of the bed with the bottom surface thereof. A guide is provided for holding a portable printing plate in a predetermined orientation when the portable printing plate is inserted in the aperture. A card validation system is disposed beneath the bed of the imprinter, the card validation system being based on the use of fluorescent markings on the portable printing plate. The card validation system includes a lamp for irradiating a portable printing plate held in the guide with radiation of a wavelength which will cause fluorescence of the fluorescent markings on the portable printing plate. A battery is provided for supplying electrical power to the lamp. A switch is provided for electrically connecting the battery to the lamp, the switch is moveable from a first position where the lamp and battery are electrically disconnected to a second position where the lamp and battery are electrically connected. The switch is yieldably urged to the first position. The switch is contactable by a portable printing plate inserted in the aperture and guided by the guide, so that in response to pressure applied on the portable printing plate the switch will be moved from the first position to the second position, and upon release of such pressure the switch will return to the second position. Closure of the switch activates the lamp, the radiation of which, in turn, activates fluorescent markings on the portable printing plate. Such fluorescent markings would be unique to an issuing institution and representative of authenticity.

BRIEF DESCRIPTION OF THE DRAWING FIGURES

DESCRIPTION OF THE PREFERRED EMBODIMENT

Figure 1:
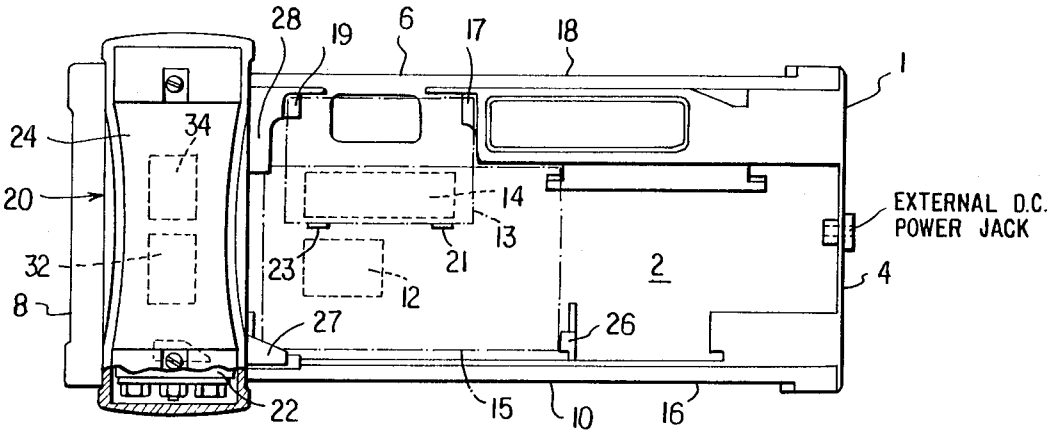
FIG. 1 is a top plan of an imprinter according to the invention, with portions broken away.
Figure 2:
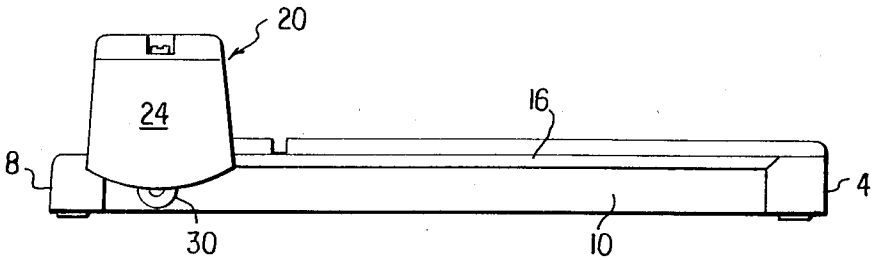
FIG. 2 is a side view of the imprinter of FIG. 1.

Referring to FIGS. 1 and 2, an imprinter is shown comprising a base 1 including a bed 2 and downwardly extending support walls 4, 6, 8 and 10. The bed 2 carries the printing elements which will be used to make impressions on a form. In the particular example shown the bed 2 is designed to carry a station plate with a printing area such as that diagrammatically illustrated within the dot-dash line 12. Such a station plate can be utilized for identifying the location, branch, store or other outlet where the impression is being made. In addition to such a station plate, the imprinter may include settable variable wheels (not shown) which can be adjusted to print other desired information such as the date of a transaction, a money amount or the like. The bed is also designed to carry a removable credit card, shown by double dot-dash line 13, whose printing area will lie in the area diagrammatically illustrated within the dot-dash line 14. The removable credit card 13 is held in place on the bed 2 by over-hanging ears 17 and 19 formed integrally with the base 1 and projections 21 and 23 extending upwardly from the bed 2. (In practice, one edge of the credit card 13 is slipped beneath the overhanging ears 17 and 19 and moved toward wall 6 until the opposite edge of the credit card 13 can be dropped behind projections 21 and 23.) Alternatively, a recess (not shown) can be formed in the bed 2, the recess receiving the credit card 13 therein. As a further alternative, such a recess (not shown) can be provided in addition to the previously described mechanism for holding a credit card in place, the recess being adapted to hold a credit card of a different size from that of the previously described mechanism. The bed 2 is also designed to hold a form, to be imprinted by the credit card and/or station plate, in place for imprinting. The form is diagrammatically illustrated by the triple dot-dash line 15. The form 15 is held in place on the bed 2 by overhanging ears 26, 27 and 28, each of said ears overhanging and engaging a respective corner of the form.

Each of the long margins of the base 1 is provided with a track designated 16 and 18, respectively, and a carriage 20 is designed to roll along the tracks 16 and 18 to be carried across the bed 2, in the lengthwise direction of the bed 2, first in one direction and then the other. The carriage 20 comprises a frame 22 and a shroud 24 which serves as a handle to operate the carriage during printing. The carriage frame 22 has attached to each end a support plate (not shown), each of which has a pair of upper wheels (not shown) and a lower wheel 30 for supporting the frame 22 above the bed 2 and guiding it along the tracks 16 and 18. Such carriages are well-known in the imprinter art and any such carriage may be utilized in the present invention.

The carriage frame 22 carries a pair of print rollers 32 and 34 which will cooperate with the printing elements appearing in the areas 12 and 14, respectively. The print rollers are mounted for rotation about axes (not shown) substantially parallel to the width-wise direction of the bed 2. Movement of the carriage 20 in the length-wise direction of the bed 2 effects relative movement between the print rollers 32 and 34 and the bed 2 thereby imprinting data from the printing area 14 of the credit card 13 and the printing area 12 of the station plate to the form 15. As is well-known in the imprinter art, the print rollers may be selectively raised and lowered during the strokes of the carriage. Additionally, a single roller may be used in lieu of the two rollers illustrated herein. Alternatively, a single roller which shifts axial position from stroke to stroke may be used to first imprint one print area during the first stroke and then print the other area on the return stroke.

In this regard, U.S. Pat. No. 3,018,725 discloses a carriage carrying a single roller wherein the roller is raised on the return stroke so that the first impression will not be blurred by a second slightly offset impression. U.S. Pat. No. 3,577,917 discloses a carriage wherein a single roller shifts from a first axial position on a first pass of the carriage, where it imprints first data area, to a second axial position on a second pass of the carriage, where it imprints a second data area. U.S. Pat. No. 3,272,120 discloses a carriage provided with two rollers wherein each roller is lined up with a respective printing area and the rollers are alternately raised and lowered in dependence on the direction of the carriage movement. U.S. Pat. No. 4,324,181 discloses a carriage provided with two rollers wherein the rollers may be selectively used in a full frame single pass or a partial frame plural pass mode. The disclosures of these U.S. Pat. Nos. 3,018,725; 3,557,917; 3,272,120 and 4,324,181 are incorporated herein by reference.

Figures 3, 4, 5, 6, 7:
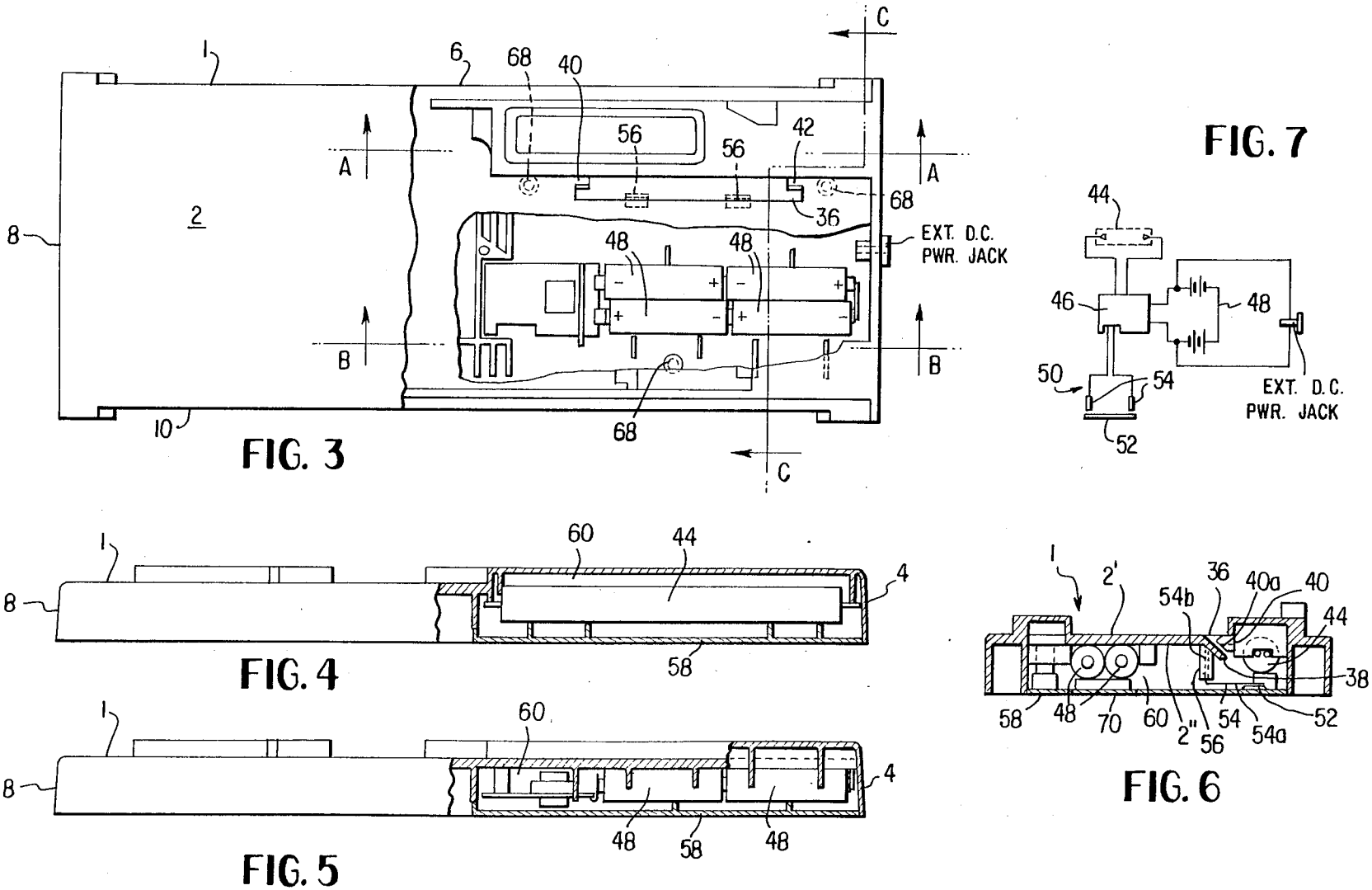
FIG. 3 is a partial top plan of the base of an imprinter according to the invention with portions broken away.
FIG. 4 is a sectional view of the base of an imprinter according to the invention, taken along line A—A of FIG. 3.
FIG. 5 is a sectional view of the base of an imprinter according to the invention, taken along line B—B of FIG. 3.
FIG. 6 is a sectional view of the base of an imprinter according to the invention, taken along line C—C of FIG. 3.
FIG. 7 is a schematic diagram of the card validation electrical circuit of the invention.
Figure 10:
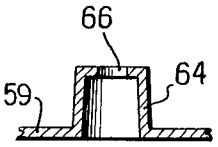
FIG. 10 is a sectional view of the bottom cover, taken along line C—C of FIG. 8.
Figure 11:
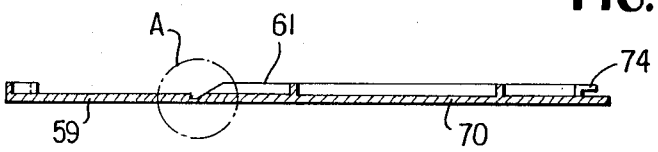
FIG. 11 is a sectional view of the bottom cover, taken along line A—A of FIG. 8.
Figure 12:
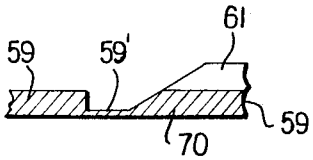
FIG. 12 is an enlarged view of detail A of FIG. 11.
Figure 13:
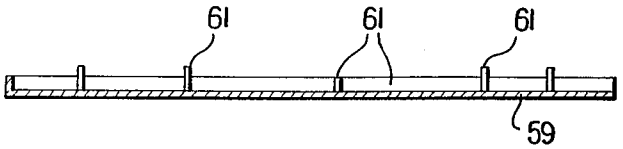
FIG. 13 is a sectional view of the bottom cover, taken along line B—B of FIG. 8.
Figure 8:
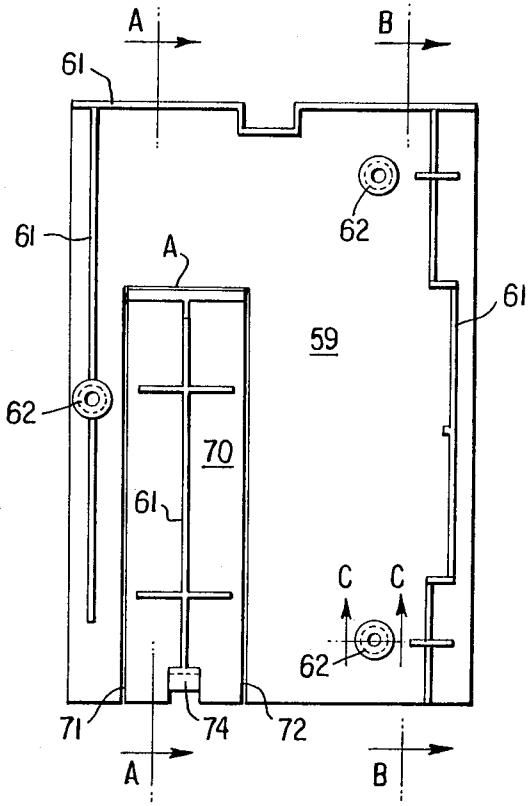
FIG. 8 is a top plan of a bottom cover according to the invention.
Figure 9:
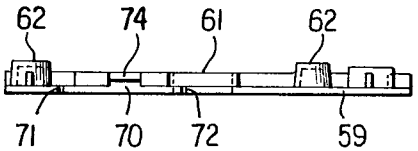
FIG. 9 is an end view of the bottom cover of FIG. 8.

Referring to FIGS. 3–6, an imprinter base 1 is illustrated comprising a bed 2 and supporting walls 4, 6, 8 and 10. A slot 36 is formed in the bed 2 and communicates, as best seen in FIG. 6, the top surface 2' of the bed with the bottom surface 2'' of the bed. A credit card can be inserted edgewise through the slot 36. The slot 36 is provided with a guide in the form of a downwardly inclined lip 38 to guide the credit card in a predetermined orientation as it is inserted in the slot 36. The downwardly inclined lip 38 is formed integrally with a lengthwise edge of the slot 36, the slot 36 extending substantially in parallel to the lengthwise direction of the bed 2. A pair of projections 40 and 42 are formed on the lengthwise edge of the slot 36 opposite the downwardly inclined lip 38. The projections extend toward the downwardly inclined lip 38, each projection having an end proximate the downwardly inclined lip 38. As may best be seen in FIG. 6 (illustrative of only one of the projections, since both are identical in conformation), a portion **40*a* of the end of the projection 40 is aligned parallel to the downwardly inclined lip 38. The downwardly inclined lip 38 and the portion 40*a* of the projection 40 (and similarly the projection 42) cooperate to hold a credit card inserted in the slot 36 in sliding contact with the downwardly inclined lip 38 and parallel to the downwardly inclined lip 38. The slot 36 is of such a width that when a credit card is inserted therein and held parallel to the downwardly inclined lip, that portion of the credit card extending below the bed 2 can be viewed from above the bed 2**.

The credit card is inserted through the slot 36 so that it may be subjected to the card validation system of the present invention. As best seen in FIG. 7, the card validation system includes an electrical circuit comprising a lamp 44, a lamp driving printed circuit board 46, a battery source of electric power 48 and a switch, generally indicated at 50, comprising a metal shorting bar 52, and a pair of metal spring leaf contacts 54. The lamp 44 is of the discharge type and, when electrical power is supplied thereto, emits radiation of a wavelength which will cause fluorescence of fluorescent markings on the credit card, such fluorescent markings being unique to an issuing institution and representative of authenticity. Fluorescent dyes and inks are well known in the chemical arts and can be printed or coated onto the credit card or impregnated into the card. Preferably, the lamp 44 emits light radiation in the ultra-violet wavelength region and the fluorescent markings fluoresce upon irradiation by light in the ultra-violet wavelength region. The battery source of electrical power can be any conventional battery, however, as indicated in FIGS. 3 and 4, four dry cell batteries connected in series are preferably used, e.g., four "AA" batteries of 1.5V each, which together generate 6V DC. The lamp driving printed circuit board is of conventional configuration for supplying electrical power from a battery source to a discharge type lamp. The supply of electrical power to the lamp 44 from the battery source 48 through lamp driving printed circuit board 46 is controlled by switch 50. The metal spring leaf contacts 54 are movable from a first position, wherein they do not contact the metal shorting bar 52, and the lamp 44 and the battery source 48 are electrically disconnected, to a second position, wherein they contact the metal shorting bar 52 and the lamp 44 and battery source 48 are electrically connected, causing the lamp to emit radiation. As may best be seen in FIGS. 6 and 3, the metal spring leaf contacts are of substantially L-shape. One leg 54*b* of the L is received and held in projection 56 depending from the bed 2 adjacent slot 36. The other leg 54*a* extends substantially perpendicular to leg 54*b* and passes beneath slot 36 and above metal shorting bar 52. When a credit card is inserted into the slot 36, the downwardly inclined lip 38 will guide the credit card past lamp 44, located on the opposite side of the slot 36 from lip 38, and into contact with legs 54*a*. Upon further insertion of the credit card into slot 36, the credit card will cause the legs 54*a* of the metal spring leaf contacts 54 to deflect downwardly and contact metal shorting bar 52. Such contact closes switch 50, supplying electrical power to lamp 44, which irradiates the credit card and causes fluorescene of the fluorescent markings on the card. These markings can be viewed through the slot 36 from above, without the necessity of exposing the viewer to the direct radiation of the lamp 44. Upon removal of the credit card from the slot 36, the release of pressure on legs 54*a* will allow these legs to spring-elastically return to their original position, thus opening switch 50 and turning off lamp 44, thus preventing battery drain. Of course the contacts 54 could be made in other than a spring leaf configuration, however, this would require the provision of an additional biasing element to yieldably urge them toward their first position.

The base 1 is further provided with a detachable bottom cover 58, which together with bed 2 and support walls 4, 6 and 10 forms a hollow chamber 60 within the base. The card validation system, previously described is entirely contained within this hollow chamber 60.

The bottom cover 58 comprises a floor 59, which is substantially rectangular in plan, and which is provided with reinforcing ribs 61 for structural strength. The bottom cover 58 is provided with bosses 62 in the form of hollow cylindrical projections 64, projecting upward from the floor 59. These projections have an axial bore 66 therethrough. Corresponding projections 68, depending from the bottom surface 2″ of the bed, allow the bottom cover 58 to be detachably connected to the base 1 by means of screws (not shown) received within the axial bores.

An access door 10, is formed in the floor 59, substantially directly below the batteries 48, for ready replacement and removal of the batteries 48. The access door 70 is formed by cutting two parallel slits 71 and 72 in the floor 59 on either side of the batteries 48, which are held in place in the base 1 by conventional spring clips (not shown). A hinge "A" is formed by providing a width wise portion 59′ of the floor 59, between the two slits 71 and 72, which is of lesser thickness than the floor 59. In this way, door 70 can be pivoted about hinge "A". A projection 74 formed on the end of the reinforcing rib 61 provided for door 70 serves as a catch which engages a corresponding projection (not shown) on support wall 4 to lock door 70 in the closed position.

What is claimed is:

1. An imprinter for use with a portable printing surface having fluorescent markings on at least one surface thereof, said imprinter comprising:

a base including a bed and downwardly extending support walls, said bed having a top surface and a bottom surface, said bed being substantially rectangular in plan, the length of which is greater than the width thereof;

printing plate holding means for holding a portable printing plate in place on said top surface of said bed;

document holding means for holding a document in place on said top surface of said bed, said document holding means holding said document in at least partially overlapping relationship with said portable printing plate;

carriage means, containing at least one print roller, guidingly and movably mounted on said base for motion in the length wise direction of the bed to effect relative movement of said print roller and said bed and thereby imprint data from said portable printing plate to said document;

aperture means, through said bed, for communicating said top surface of said bed with said bottom surface of said bed, said aperture means receivable of said portable printing plate therein;

guide means for holding said portable printing plate in a predetermined orientation in said aperture means; and card validation means comprising:

lamp means for irradiating a portable printing plate held in said guide means with radiation of a wavelength which will cause fluorescence of said fluorescent markings on said portable printing plate;

battery means for supplying electrical power to said lamp means;

switch means for connecting said battery means to said lamp means, said switch means movable from a first position wherein said lamp means and said battery means are electrically disconnected to a second position wherein said lamp means and said battery means are electrically connected, biasing means for yieldably urging said switch means to said first position, said switch means being contactable by a portable printing plate inserted in said aperture means and movable from said first position to said second position in response to pressure applied upon said portable printing plate.

2. The imprinter as claimed in claim 1, wherein said aperture means comprises a slot extending in the lengthwise direction of the bed, said slot being of a width sufficient to allow viewing of at least that portion of a portable printing plate inserted therein and extending below said bed.

3. The imprinter as claimed in claim 2, wherein said guide means comprises a downwardly inclined lip integral with a length wise edge of said slot.

4. The imprinter as claimed in claim 3, wherein said guide means further comprises a pair of ribs extending from the lengthwise side of said slot opposite said downwardly inclined lip toward said downwardly inclined lip, said pair of ribs each having an end proximate said downwardly inclined lip, a portion of each of said rib ends aligned parallel to said downwardly inclined lip, said downwardly inclined lip and said portions of said rib ends cooperating to hold said portable printing plate in sliding contact therebetween parallel to said downwardly inclined lip.

5. The imprinter as claimed in claim 3, wherein said lamp means is located on the opposite side of said slot from said downwardly inclined lip.

6. The imprinter as claimed in claim 5, wherein said lamp means emits light in the ultra-violet wavelength region and said fluorescent markings fluoresce upon irradiation by light in the ultra-violet wavelength region.

7. The imprinter as claimed in claim 1, wherein said switch means and said biasing means are integrally formed with one another.

8. The imprinter as claimed in claim 7, wherein said switch means comprises two metal spring leafs proximate a metal shorting bar and contactable therewith, each metal spring leaf being electrically connected to a respective end of an electrical circuit electrically connecting said battery means and said lamp means, each metal spring leaf being contactable by said portable printing plate and movable from said positions proximate said metal shorting bar into contact with said metal shorting bar upon application of pressure to said portable printing plate thereby closing said electrical circuit connecting said battery means and said lamp means and upon release of pressure applied by said portable printing plate said metal spring leafs returning to said positions proximate said metal shorting bar thereby opening said electrical circuit connecting said battery means and said lamp means.

9. The imprinter as claimed in claim 1, wherein said base further comprises a bottom cover detachably connected to said base, said bottom cover, said supporting walls and said bed defining a hollow chamber, said card validation means contained within said hollow chamber.

10. The imprinter as claimed in claim 9, wherein said battery means comprises at least one dry cell battery.

11. The imprinter as claimed in claim 10, wherein said bottom cover includes an access means, proximate said at least one dry cell battery, for removal and replacement of said at least one dry cell battery therethrough.

12. The imprinter as claimed in claim 11, wherein said access means comprises a door pivotable about a hinge between an open position and a closed position, said hinge formed integrally with said door and said bottom cover, said door provided with locking means to lock said door in said closed position.

* * * * *